US006308647B1

(12) United States Patent
Okabe et al.

(10) Patent No.: US 6,308,647 B1
(45) Date of Patent: Oct. 30, 2001

(54) INTERLOCK STITCH SEWING MACHINE FOR BLINDSTITCH HEMMING WITH SLIPPAGE PREVENTING DEVICE

(75) Inventors: Masato Okabe; Norio Nakata; Hiromichi Kurata; Takayoshi Masaoka; Itsuo Sakai, all of Toyonaka (JP)

(73) Assignee: Yamato Sewing Machine Seizo Co., Ltd. (JP)

( * ) Notice: Subject to any disclaimer, the term of this patent is extended or adjusted under 35 U.S.C. 154(b) by 0 days.

(21) Appl. No.: 09/565,360

(22) Filed: May 5, 2000

(30) Foreign Application Priority Data

Jun. 15, 1999 (JP) ..... 11-206644

(51) Int. Cl.[7] ..... D05B 35/10; D05B 69/36

(52) U.S. Cl. ..... 112/272; 112/140; 112/475.02

(58) Field of Search ..... 112/272, 140, 112/141, 143, 153, 176, 306, 475.02, 475.03, 475.24

(56) References Cited

U.S. PATENT DOCUMENTS 5,010,833 * 4/1991 Spencer, III et al. ..... 112/147

5,899,159 * 5/1999 Dasher et al. ..... 112/306 X

* cited by examiner

*Primary Examiner*—Peter Nerbun
(74) *Attorney, Agent, or Firm*—D. Peter Hochberg; Katherine R. Vieyra; William H. Holt

(57) ABSTRACT

An interlock stitch sewing machine for blindstitch hemming with a slippage preventing device is provided which is so constructed as to prevent slippage that is likely to occur due to a position error of a lower fabric portion of the fabric portions stacked by a top-stitching at the fabric end, or a locally deformed portion due to a cutting error, in the blindstitch hemming of a tubular article such as T-shirts or underwear. A top-stiching width guide and a fabric edge guide are oppositely disposed in front of a needle location. A slippage detecting sensor that detects the edge position of the lower fabric portion to detect the presence of slippage, is attached to the fabric edge guide. When the slippage quantity detected by the sensor exceeds a permissible slippage quantity, it is determined there is possibility of slippage, and an informing means is operated. Thereby, a faulty sewing such as slippage can be reliably prevented by previously detecting a position error of the lower fabric portion or a deformed portion due to a cutting error.

6 Claims, 9 Drawing Sheets

INTERLOCK STITCH SEWING MACHINE FOR BLINDSTITCH HEMMING WITH SLIPPAGE PREVENTING DEVICE

BACKGROUND OF THE INVENTION

1. Field of the Invention

The present invention relates to an interlock stitch sewing machine for blindstitch hemming with a slippage preventing device. More particularly, the invention relates to an interlock stitch sewing machine for blindstitch hemming with a slippage preventing device which is constructed so as to prevent such slippage that is liable to occur in the blindstitch hemming of a tubular article such as T-shirts or underwear. Specifically, of fabric portions stacked by a top-stitching at the fabric end, a lower fabric portion slips, or a locally deformed portion due to a cutting error is present at the edge of the lower fabric portion.

2. Description of the Prior Art

FIG. 11 illustrates a construction of a major part of a three-needle interlock stitch sewing machine for blindstitch hemming which has conventionally being in general use. In this sewing machine, paired front and rear feed dogs (which are not shown because this is known) which feed a tubular article W in a sewing direction indicated by the arrow Y, are disposed underneath a throat plate 2 provided on the upper surface of a sewing machine bed 1. A pressure foot 3 that presses the article W against the upper surface of the throat plate 2, and three needles 4 that are movable vertically reciprocally are supported on an arm 5 disposed above the throat plate 2. In front of the pressure foot 3 and a needle location 6 formed in the throat plate 2, a top-stitching width guide 7 and a fabric edge guide 8 are oppositely disposed in a direction orthogonal to the sewing direction Y. The top-stitching width guide 7 defines a top-stitching width h toward the back of the edge of the article W, and makes contact with a bent portion W2*a* formed by a lower fabric portion W1 and an upper fabric portion W2 overlying thereon, to guidedly feed the bent portion W2*a* in the sewing direction Y. The fabric edge guide 8 makes contact with an edge W1*a* of the lower fabric portion W1 to guidedly feed the edge W1*a* in the sewing direction Y.

In the three-needle interlock stitch sewing machine for blindstitch hemming so constructed, the rotation of the sewing machine is started when the operator sets the article W on the surfaces of the bed 1 and throat plate 2, while the end of the article W is folded downwardly through the top-stitching width guide 7, so as to obtain an approximately constant top-stitching width h. As the sewing machine is rotated, the fabric portions W2 and W1 which are stacked at the top-stitching are subsequently fed in the sewing direction Y along the upper surface of the throat plate 2, by up and down movements of the paired feed dogs and by the pressure foot 3 cooperating with the movements of the feed dogs. Then, when the fabric portions W2 and W1 reach the needle location 6, the three needles 4 and a looper (not shown) cooperate to form a stitch Wa that is wide in the direction in which the fabric portions W2 and W1 cross at a right angle to the sewing direction Y, as shown in FIG. 12, thereby performing a predetermined interlock stitch sewing.

In such a blindstitch hemming sewing, as indicated by virtual line in FIG. 11, the bent portion W2*a* of the upper fabric portion W2 and the edge W1*a* of the lower fabric portion W1 make contact with the top-stitching width guide 7 and fabric edge guide 8, respectively, thereby to be guidedly fed in the sewing direction Y. That is, the conventional interlock stitch sewing machine for blindstitch hemming is so constructed that a blindstitch hemming while retaining a constant top-stitching width h of the lower fabric portion W1, is carried out only by slidingly guiding the ends of the upper and lower fabric portions (i.e., the bent portion W2*a* and the edge W1*a*), by the top-stitching width guide 7 and fabric edge guide 8 oppositely disposed in front of the needle location 6.

In the above sewing machine, however, of the fabric portions W2 and W1 stacked at the top-stitching, the lower fabric portion W1 is extremely hard to see by the operator's eye. It is therefore difficult that the top-stitching toward the back of the fabric end is always kept constant only by the top-stitching width guide 7 and fabric edge guide 8. It is also very difficult to adjust the top-stitching width in the course of the fabric feed. Thus, the stacked fabric portions tend to be guidedly fed to the needle location 6 in the state that the edge W1*a* of the lower fabric portion W1 has a position error, thereby causing slippage. In addition, even if a locally deformed portion is present at the edge W1*a* of the lower fabric portion W1, it is difficult to observe the deformed portion by the eye during the sewing operation. Therefore, when the deformed portion is large in the sewing direction, a faulty sewing such as slippage is liable to occur. Hence, it has conventionally been indispensable to conduct, after sewing operation, a product inspection to visually inspect for faulty sewing such as slippage.

SUMMARY OF THE INVENTION

It is therefore an object of the present invention to provide an interlock stitch sewing machine for blindstitch hemming equipped with a slippage preventing device which can reliably prevent the occurrence of a faulty sewing such as slippage, by previously detecting the cause of the faulty sewing due to the position error of a lower fabric portion or a cutting error.

According to the present invention, in an interlock stitch sewing machine for blindstitch hemming which comprises a top-stitching width guide that defines the width of a top-stitching toward the back of a fabric and makes contact with a bent portion of a lower fabric portion and an upper fabric portion overlying thereon in the top-stitching, to guidedly feed the bent portion in a sewing direction, and a fabric edge guide that makes contact with an edge of the lower fabric portion to guidedly feed the edge in the sewing direction, the top-stitching width guide and the fabric edge guide being oppositely disposed in front of a needle location in a direction orthogonal to the sewing direction, is characterized in having a slippage preventing device comprising: a slippage detecting sensor attached to the fabric edge guide, the sensor detecting slippage of the upper and lower fabric portions by detecting the position of an edge of the lower fabric portion to be guidedly fed by the guide; and an informing means that compares a slippage quantity detected by the slippage detecting sensor and a preset permissible slippage quantity, and, when the slippage quantity exceeds the permissible slippage quantity, determines the possibility of slippage and performs an informing operation.

With this construction, in a predetermined blindstitch hemming sewing, when the setting of the edge of the lower fabric portion which is extremely hard to be seen from the operator is so shifted as to cause slippage, when such a position error as to cause slippage during feed in a sewing direction is created, or when a large locally deformed portion due to a cutting error is present at the edge of the lower fabric portion, the slippage detecting sensor detects these factors of causing a faulty sewing, and the informing means is operated to inform the operator of the possibility of slippage before sewing. That is, the factor of causing a faulty sewing is removed before the stacked upper and lower fabric portions reach the needle location, and these fabric portions is subjected to sewing while a predetermined width overlap allowance is ensured. This enables to reliably prevent the occurrence of a faulty sewing such as slippage, increase yield and achieve labor saving by omitting a visual product inspection after sewing.

Preferably, the above sewing machine is provided with a translucent plate that slidingly guides the lower fabric portion in the sewing direction is disposed in front of the fabric edge guide; and a light source that applies an upward light to the back of the translucent plate to illuminate the lower fabric portion.

With this construction, in front of the top-stitching width guide and fabric edge guide, by illuminating from underside the lower fabric portion, the operator in its ordinary sewing attitude can visually and easily check from above the edge position of the lower fabric portion. Thereby, the possibility of slippage which can be caused by a position error at the edge or a locally deformed portion due to a cutting error, can be known promptly and such a faulty sewing factor can be removed in an early stage, thus allowing to avoid the interruption of the sewing operation caused by the operation of the informing means. Therefore, excellent blindstitch hemming sewing free from faulty sewing is executable maintaining high sewing efficiency.

Preferably, the above translucent plate is colored to fluorescent color. Thereby, even when white or whitish fabric is a sewing object, the light applied from underside of the translucent plate will not be absorbed, and the shadow along the edge position of the lower fabric portion can be clearly projected on the translucent plate. This ensures the operator's visual check of the edge position and enables to remove a faulty sewing factor in an early stage, irrespective of the fabric color. Therefore, excellent blindstitch hemming sewing free from faulty sewing can be reliably performed at high sewing efficiency.

Preferably, the above translucent plate has a matchmark, the tip of the matchmark is located on an extension line parallel with the sewing direction of the fabric edge guide, and the matchmark is apart from the extension line at a given angle, toward its back end. Thereby, a triangular blank is formed between the edge of the lower fabric portion at the top-stitching and the matchmark. Through this blank, the edge position is so adjusted as to align with the tip of the matchmark. Therefore, the prevention of slippage due to a position error can be further improved by aligning the edge of the lower fabric portion with the fabric edge guide.

These and other objects, features, aspects and advantages of the present invention will become more apparent from the following detailed description of the present invention when taken in conjunction with the accompanying drawings.

DESCRIPTION OF THE PREFERRED EMBODIMENT

One preferred embodiment of the present invention will be described by referring to the accompanying drawings.

Figure 1:
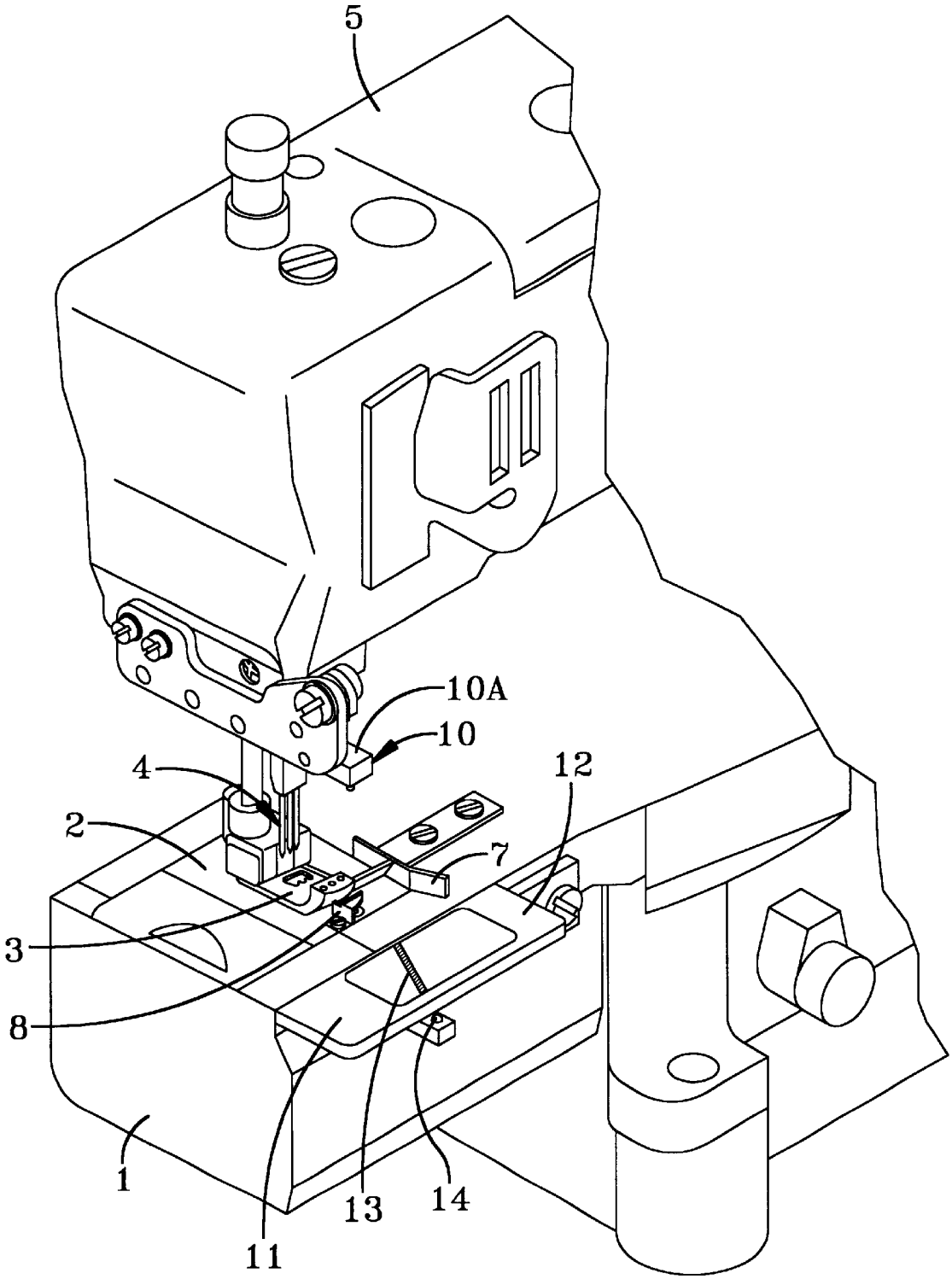
FIG. 1 is a perspective view of a main part of a three-needle interlock stitch sewing machine for blindstitch hemming with a slippage preventing device, according to the present invention.
Figure 2:
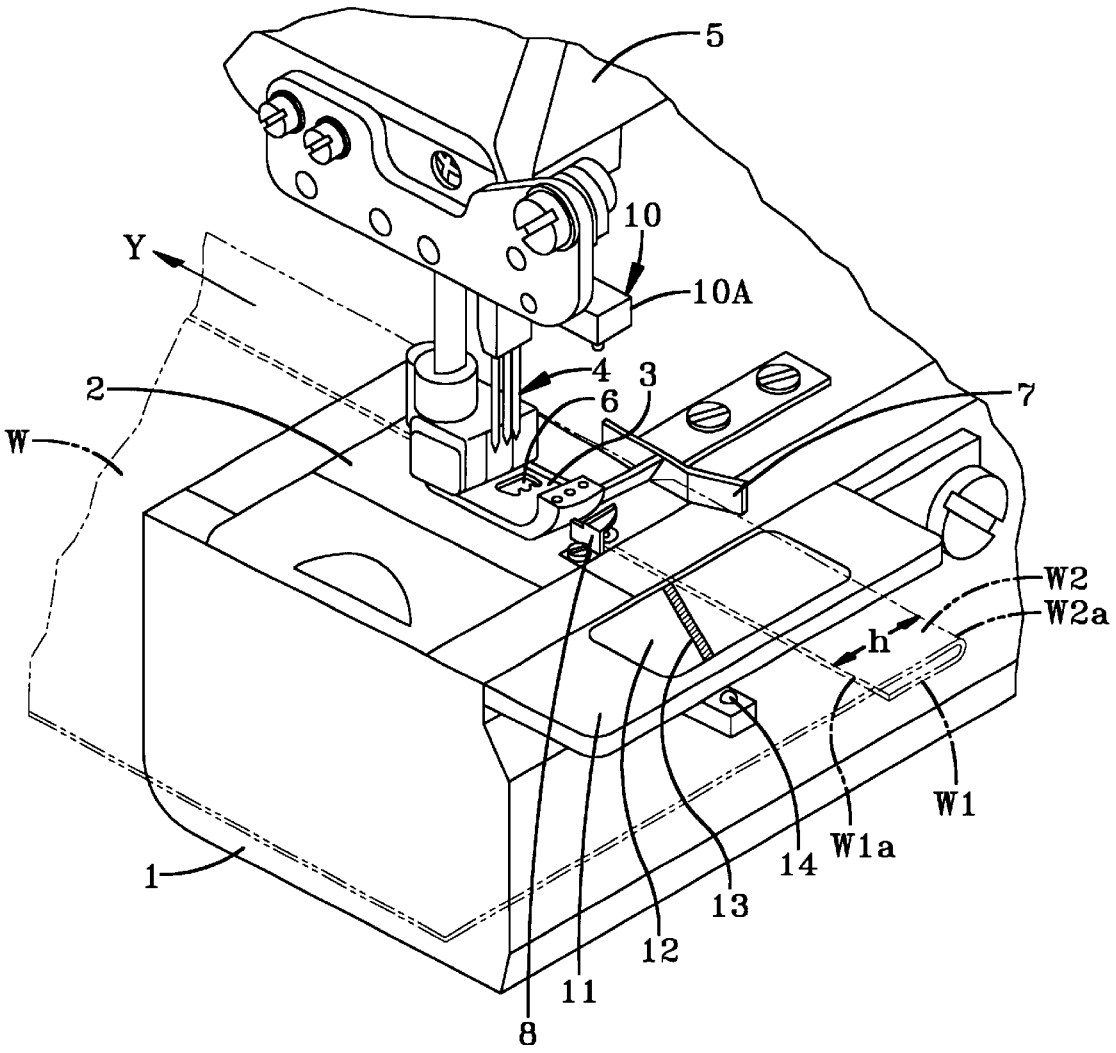
FIG. 2 is a perspective view illustrating the construction of the main part of the above sewing machine.
Figure 11:
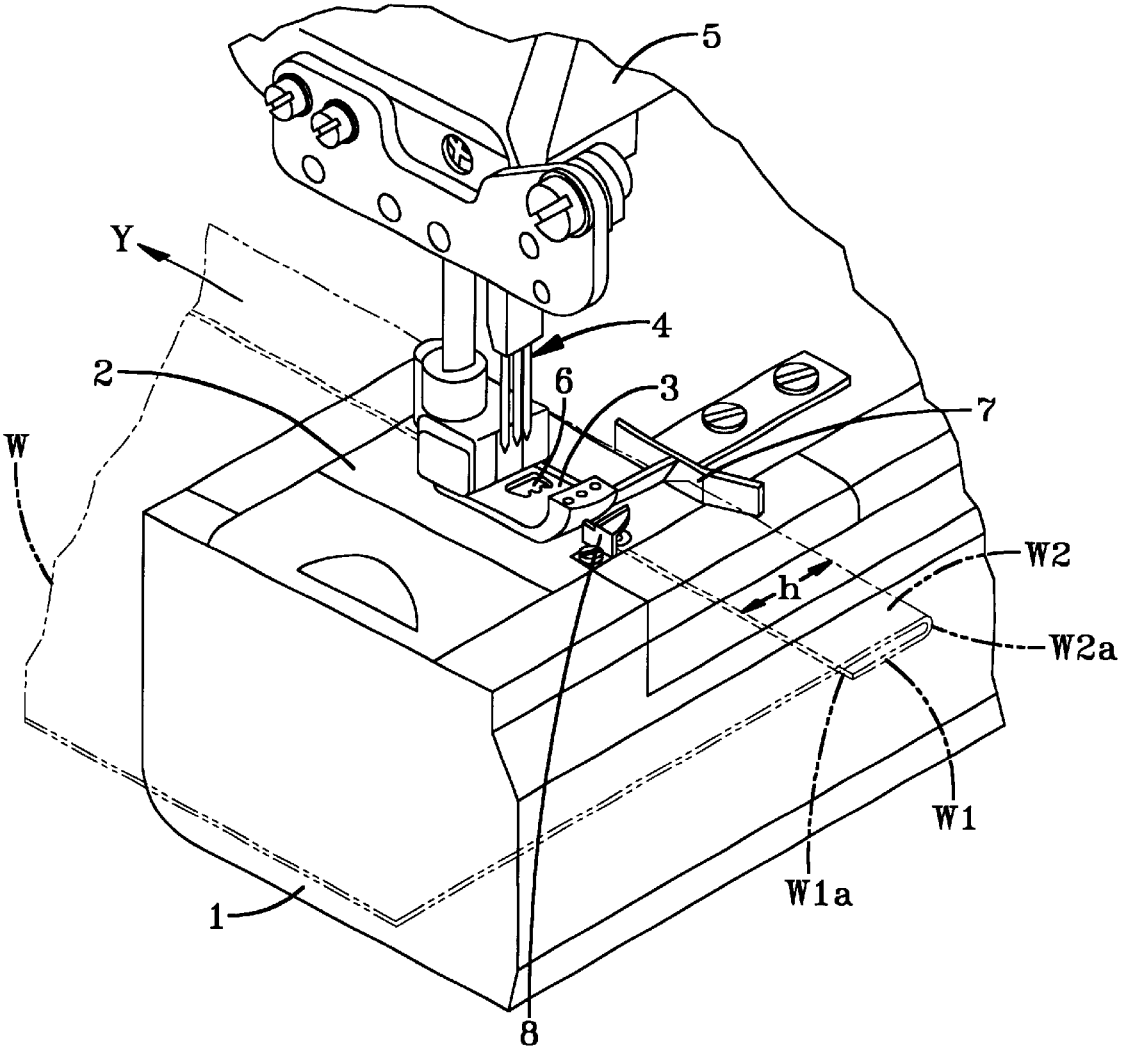
FIG-11 PRIOR ART
FIG. 11 is a perspective view of the construction of a main part of a conventional three-needle interlock stitch sewing machine for blindstitch hemming.

FIG. 1 is a perspective view of a main part of a three-needle interlock stitch sewing machine for blindstitch hemming with a slippage preventing device. FIG. 2 is a perspective view illustrating the construction of the main part of this sewing machine. The basic construction of the sewing machine shown in FIGS. 1 and 2 is the same as the conventional sewing machine shown in FIG. 11. Therefore, the same references have been retained for similar parts which have the same functions, namely, a sewing machine bed 1, throat plate 2, pressure foot 3, needles 4, arm 5, needle location 6, top-stitching width guide 7, and fabric edge guide 8. A detailed description thereof is thus omitted.

Figure 3:
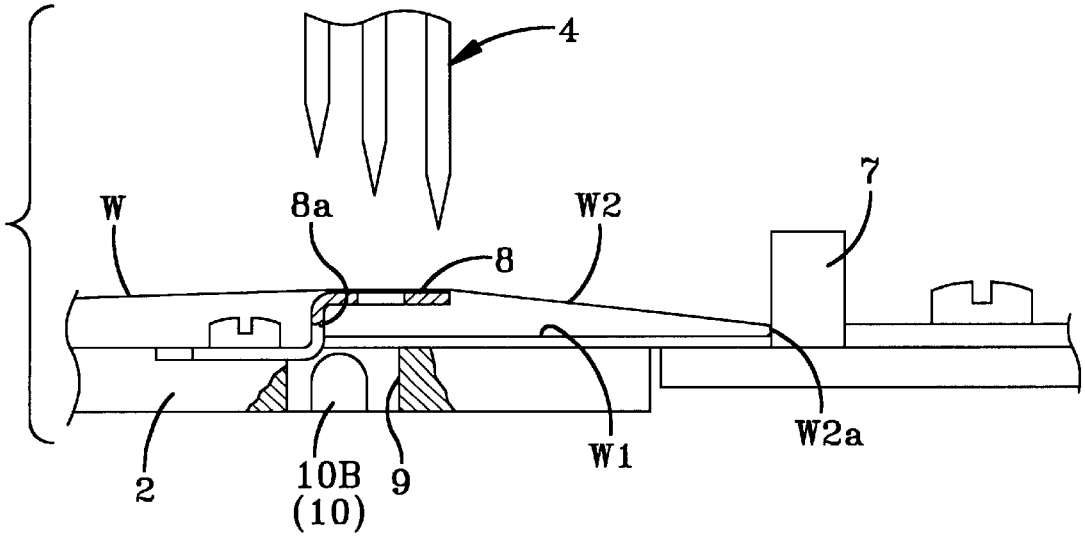
FIG. 3 is a sectional front view, partially in enlarged dimension, of the main part of the above sewing machine.

FIG. 3 is a sectional front view, partially in enlarged dimension, of the main part of the above sewing machine. As shown in FIG. 3, a longitudinal through hole 9 is provided at the portion of the throat plate 2 which is located slightly nearer to the top-stitching width guide 7 than a vertical guide surface 8*a* of the fabric edge guide 8. Disposed in the arm 5 immediately above the through hole 9 and in the through hole 9 are a light transmission slippage detecting sensor 10 comprising a floodlight 10A (see FIG. 2) and a receiver 10B, by which it is able to detect slippage of the upper and lower fabric portions W2 and W1 by detecting the position of an edge W1*a* of the lower fabric portion W1 which is brought into contact with the vertical guide surface 8*a* of the fabric edge guide 8, and then is guidedly fed in a sewing direction Y. The slippage detecting sensor 10 is so constructed as to detect the possibility of slippage by determining whether the overlapping number of the upper and lower fabric portions W2 and W1 is one or two, based on variations in the amount of light received by the receiver 10B.

Figure 4:
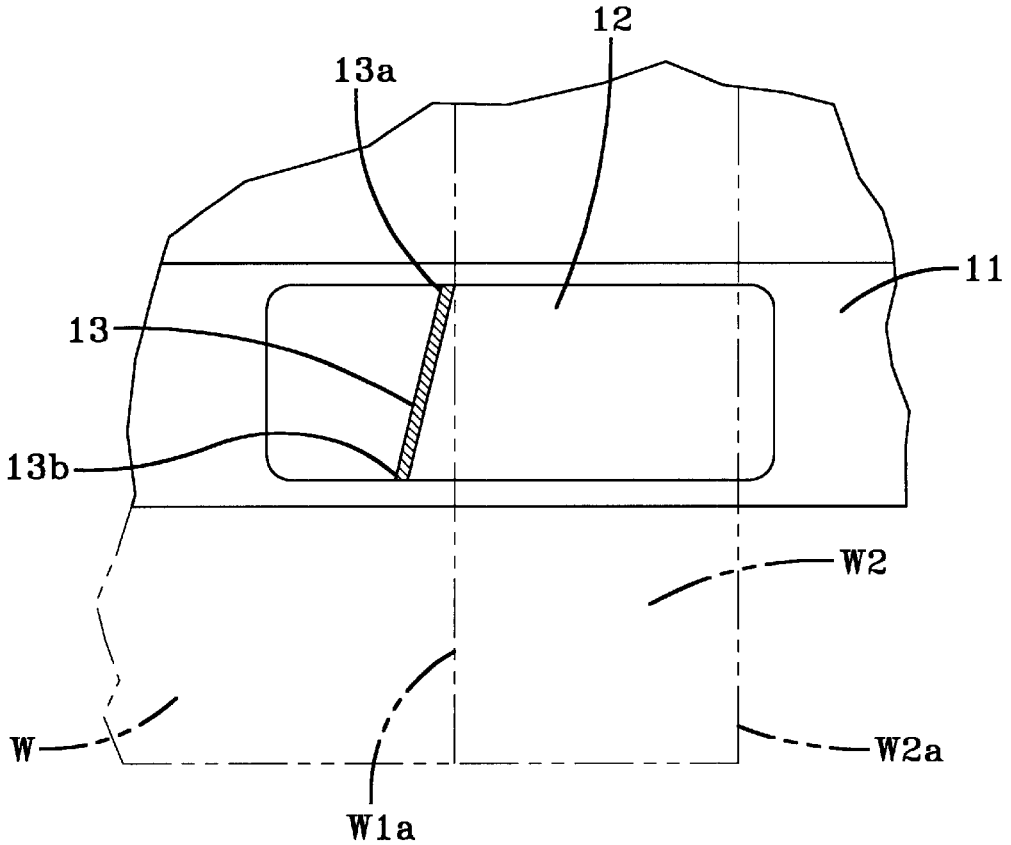
FIG. 4 is an enlarged plan view of the main part of the above sewing machine.

In addition to the slippage detecting sensor 10, a translucent plate 12 made of a transparent resin, which is wider than a top-stitching width h defined by the top-stitching width guide 7 and fabric edge guide 8, is disposed in front of the top-stitching width guide 7 and fabric edge guide 8, so as to project from the bed 1 to the front thereof. The translucent plate 12 slidingly feeds the lower fabric portion W1 in the sewing direction Y, through a plate-like holder 11 having an upper surface even with the upper surface of the throat plate 2. The translucent plate 12 is colored to fluorescent color such as light green, and a linear matchmark 13 is attached to the translucent plate 12, as shown in FIG. 4. The matchmark 13 is used in performing alignment between the edge W1*a* of the lower fabric portion W1 and the vertical guide surface 8*a* of the fabric edge guide 8. A tip 13*a* of the matchmark 13 is located on an extension line parallel with the sewing direction Y of the vertical guide surface 8*a* of the fabric edge guide 8, and is more apart from the extension line as being closer to its back end 13*b*.

A light emitting diode (LED) 14 as a light source, from which an upward light is applied to illuminate the lower fabric portion Wi, is secured beneath the translucent plate 12. The lower fabric portion W1 located in front of the top-stitching width guide 7 and fabric edge guide 8 is illuminated from a lower part by applying light from the LED 14. Thereby, a shadow along the position of the edge W1*a* of the lower fabric portion W1 is projected on the translucent plate 12, so that the position of the edge of the lower fabric portion W1 is visually checked from above.

Figure 5:
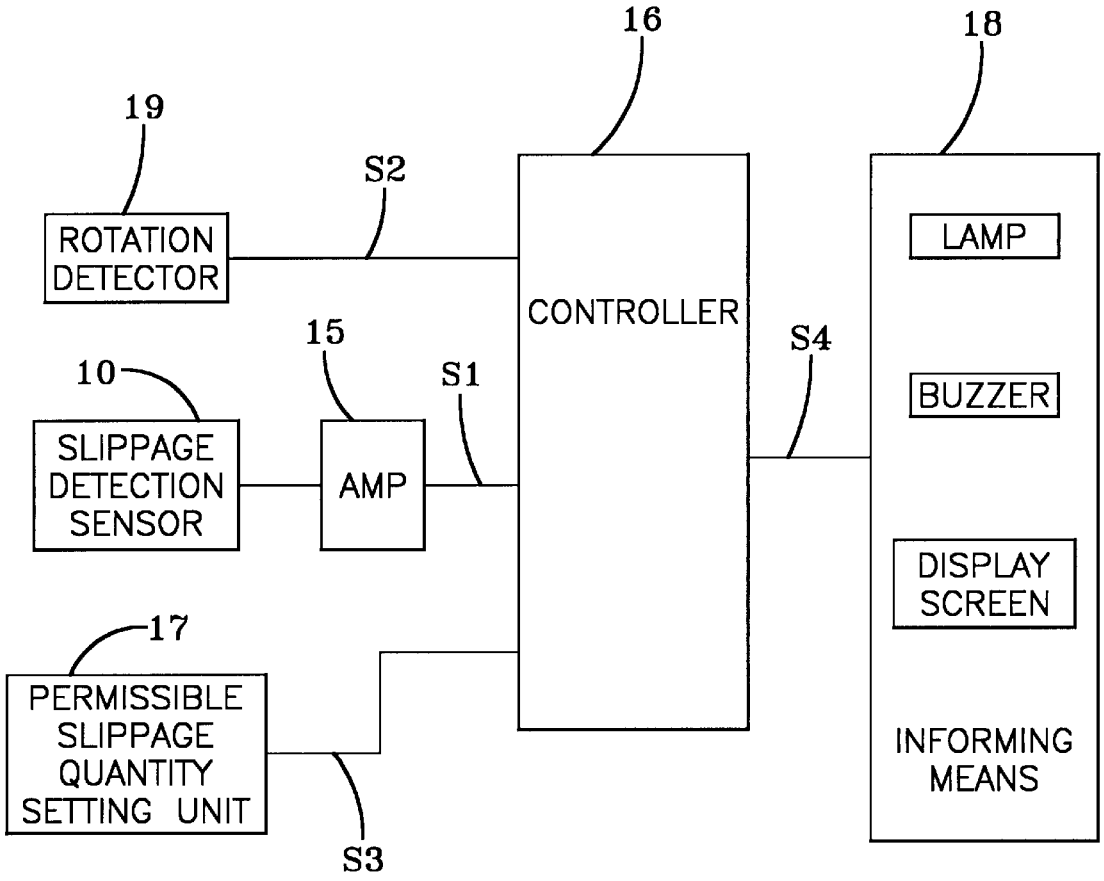
FIG. 5 is a block diagram of the circuit configuration of the slippage preventing device incorporating a slippage detecting sensor in the above sewing machine.

FIG. 5 is a block diagram of the circuit configuration of a slippage preventing device incorporating the slippage detecting sensor 10. A detecting signal S1 from the slippage detecting sensor 10 is amplified by an amplifier 15, and then inputted to a controller 16. In addition to the detecting signal S1, a detecting signal S2 from a rotation detector 19 for detecting rotation which is attached to the interlock stitch sewing machine, and a permissible slippage quantity (the number of stitches) setting signal S3 from a permissible slippage quantity setting unit 17 that previously sets the number of stitches as a permissible slippage quantity in the length in the sewing direction Y, are inputted to the controller 16. An informing means 18, such as a lamp, buzzer or display screen, is connected to the controller 16. In the controller 16, the number of stitches that corresponds to the continuous input time of the slippage detecting signal S1 is compared with the permissible number of stitches of the setting signal S3. When the detected number of stitches exceeds the permissible number of stitches, the controller 16 determines the possibility of slippage and outputs a signal S4. On receipt of the signal S4, the informing means 18 executes an informing operation. That is, it lights up the lamp, sounds the buzzer, or activates the display screen, so that the operator is informed of the possibility of slippage.

Figure 6:
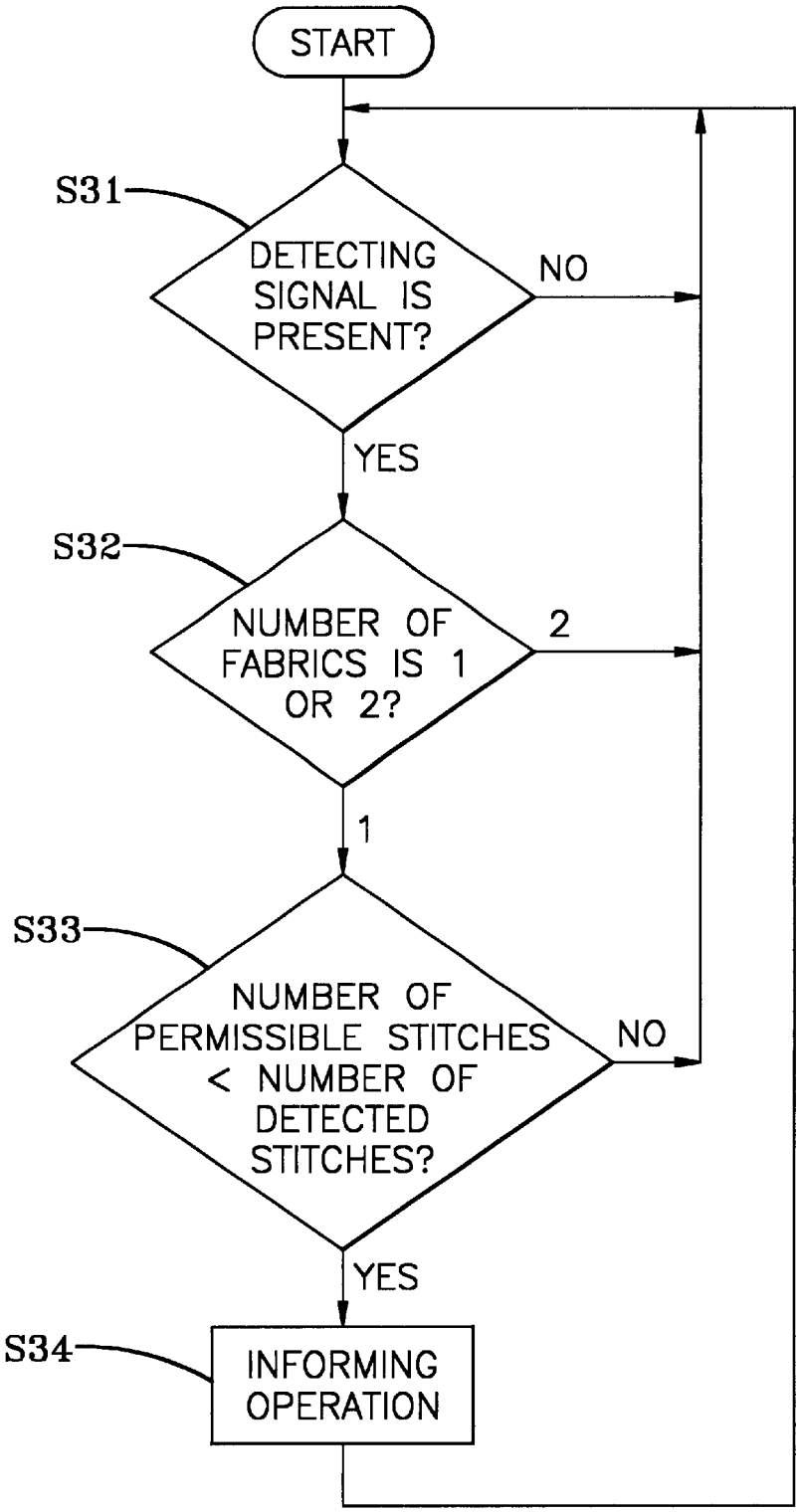
FIG. 6 is a flow chart illustrating an interlock stitch sewing and a slippage preventing operation during this sewing.

Referring now to the flow chart of FIG. 6, description will be given of a blindstitch hemming sewing and a slippage preventing operation during this sewing, in the interlock stitch sewing machine for blindstitch hemming with a slippage preventing device so constructed.

Figure 12:
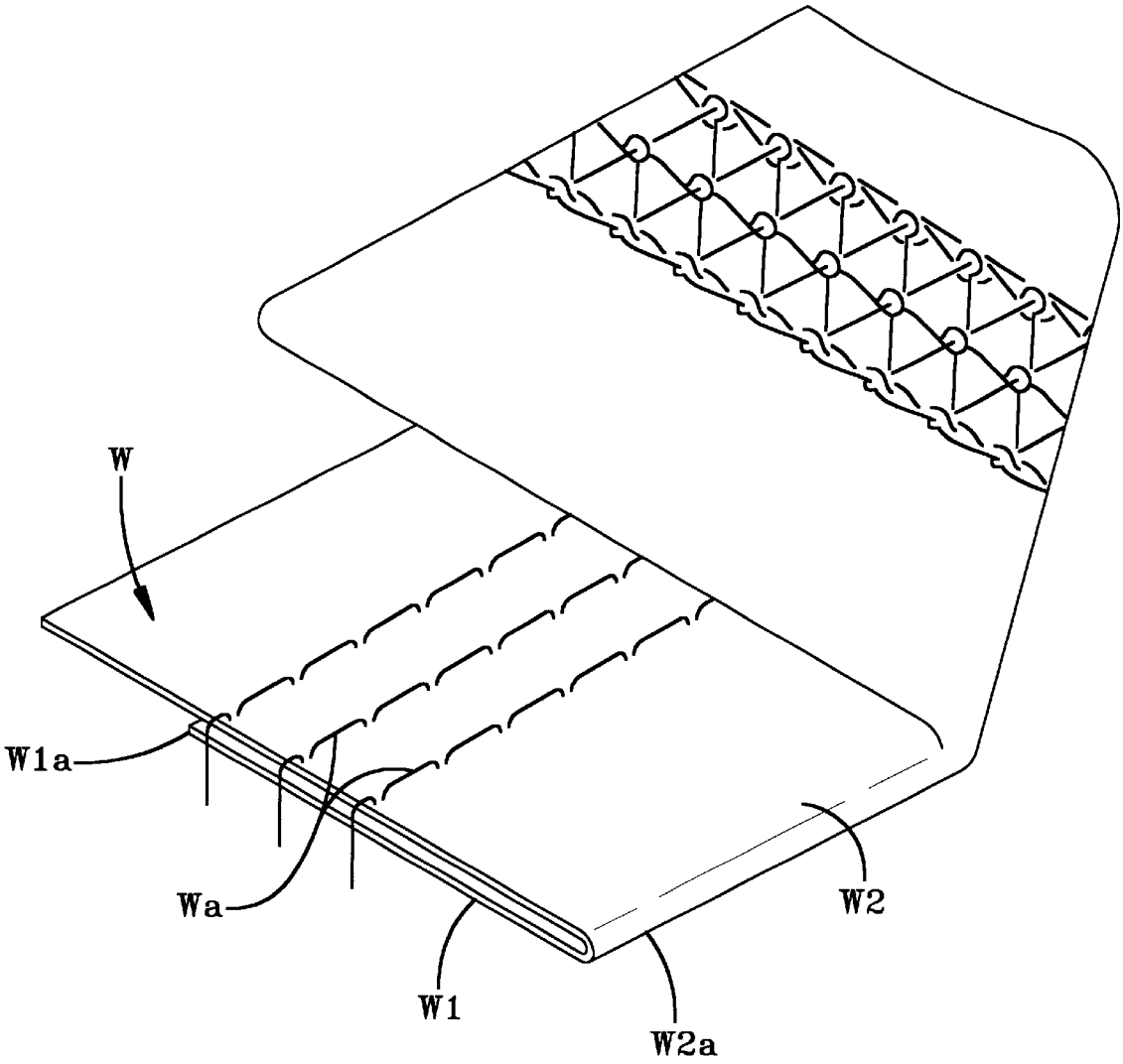
FIG. 12 is an enlarged perspective view of a main part of a product after being subjected to a predetermined blindstitch hemming.

By the manual operation of the operator, a tubular article W, such as a T-shirt, is set on the upper surfaces of a bed 1 and throat plate 2, while the fabric edge is bent downwardly via a top-stitching width guide 7, to obtain an approximately constant top-stitching width h. Thereafter, the rotation of the sewing machine is initiated. As the sewing machine is rotated, fabric portions W2 and W1 stacked at the top-stitching are subsequently fed in a sewing direction Y along the upper surface of the throat plate 2, by up and down movements of a pair of front and rear feed dogs and by a pressure foot 3 that cooperates with this movements. At this time, a bent portion W2*a* of the upper fabric portion W2 and an edge W1*a* of the lower fabric portion W1 are brought into contact with the vertical guide surface 8*a* of the fabric edge guide 8 and then slidingly fed in the sewing direction Y. When the fabric portions W2 and W1 reach a needle location 6, three needles 4 and a looper (not shown) cooperate to form a stitch Wa, as shown in FIG. 12, thereby performing a predetermined interlock stitch sewing.

In such a blindstitch hemming sewing, the lower fabric portion W1 in front of the top-stitching width guide 7 and fabric edge guide 8 is illuminated by applying an upward light from the LED 14 beneath the translucent plate 12 disposed in front of the top-stitching width guide 7 and fabric edge guide 8, so that a shadow along the position of the edge W1*a* of the lower fabric portion W1 is projected on the translucent plate 12. By watching this shadow, the operator in his or her ordinary sewing attitude can visually check from above the edge position of the lower fabric portion W1. This visual check enables to promptly find a position error of the edge W1*a* of the lower fabric portion W1 which can cause slippage, and then correct the position error.

When the stacked upper and lower fabric portions W2 and W1, having a position error that is not corrected or is overlooked, are fed to the location of the top-stitching width guide 7 and fabric edge guide 8, the slippage detecting sensor 10 determines whether the fabric portions W2 and W1 have such a position error that can cause slippage. Specifically, depending on variations in the amount of light received by the receiver 10B of the slippage detecting sensor 10, it is detected whether the overlapping number of the upper and lower fabric portions W2 and W1 is one or two, thereby to detect a position error causing slippage (Steps S31 and S32).

Figure 7:
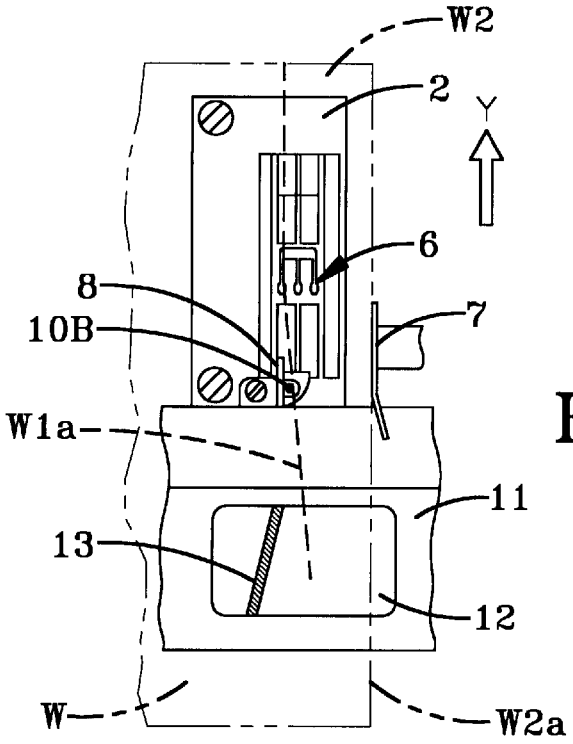
FIG. 7 is a plan view of a main part illustrating the state of a position error that is one factor of slippage in a blindstitch hemming sewing.
Figure 8:
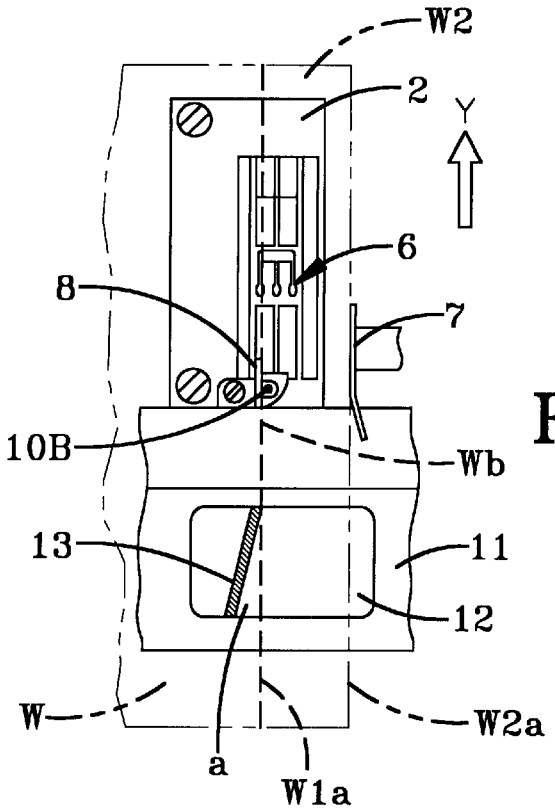
FIG. 8 is a plan view of a main part illustrating the state of a deformed portion that is one factor of slippage in a blindstitch hemming sewing.

When there is no position error causing slippage and the overlapping number is two, an article W is fed as it is in the sewing direction Y, and then subjected to a predetermined blindstitch hemming On the other hand, when the overlapping number is one because the edge W1*a* of the lower fabric portion W1 has such a position error as to be apart from the vertical guide surface 8*a* of the fabric edge guide 8, as shown in FIG. 7, or alternatively, the edge W1*a* has a locally deformed portion with recess Wb due to a cutting error of the article W, as shown in FIG. 8, a detecting signal S1 from the slippage detecting sensor 10 is inputted to the controller 16.

A stitch number setting signal S3 as a permissible slippage quantity in the length in the sewing direction Y, which is previously set in a permissible slippage quantity setting unit 17 by the operator or the like, is already inputted to the controller 16. The number of permissible stitches of the setting signal S3 is compared with the number of detected stitches of the detecting signal S1 (Step S33). When the number of the detected stitches is less than or equal to the number of the permissible stitches, no signal S4 is outputted. When the former is greater than the latter, the controller 16 determines the possibility of slippage and outputs a signal S4. The signal S4 is then inputted to the informing means 18, and a predetermined informing operation is executed (Step S34).

By the informing operation from the informing means 18, the operator is informed of the possibility of slippage. The position error shown in FIG. 7 is corrected before it reaches the needle location 6. In the case that a locally deformed portion with recess Wb due to a cutting error extends beyond a predetermined length in the sewing direction Y, as shown in FIG. 8, a faulty sewing product is unavoidable if the sewing proceeds as it is. Therefore, the sewing operation is stopped and the article W is removed to prevent a faulty sewing due to slippage or the like. This enables to omit the step of visual product inspection to be conducted after the sewing operation.

When the position error as shown in FIG. 7 is detected and then corrected according to the informing operation by the informing means 18, since the translucent plate 12 has the linear matchmark 13 that is diagonal as shown in FIG. 4, and, the shadow of the position of the edge W1*a* of the lower fabric portion W1 that is hard to see from above is projected on the translucent plate 12, the operator can make an adjustment such that the position of the edge W1*a* is aligned with a tip 13*a* of the matchmark 13, by watching the shade of the edge W1*a* through a triangular blank a formed by the edge W1*a* and the matchmark 13. Thereby, the position error can be easily corrected by aligning the edge W1*a* with the vertical guide surface 8*a* of the fabric edge guide 8, and thus the prevention of slippage can be further improved.

Figure 9:
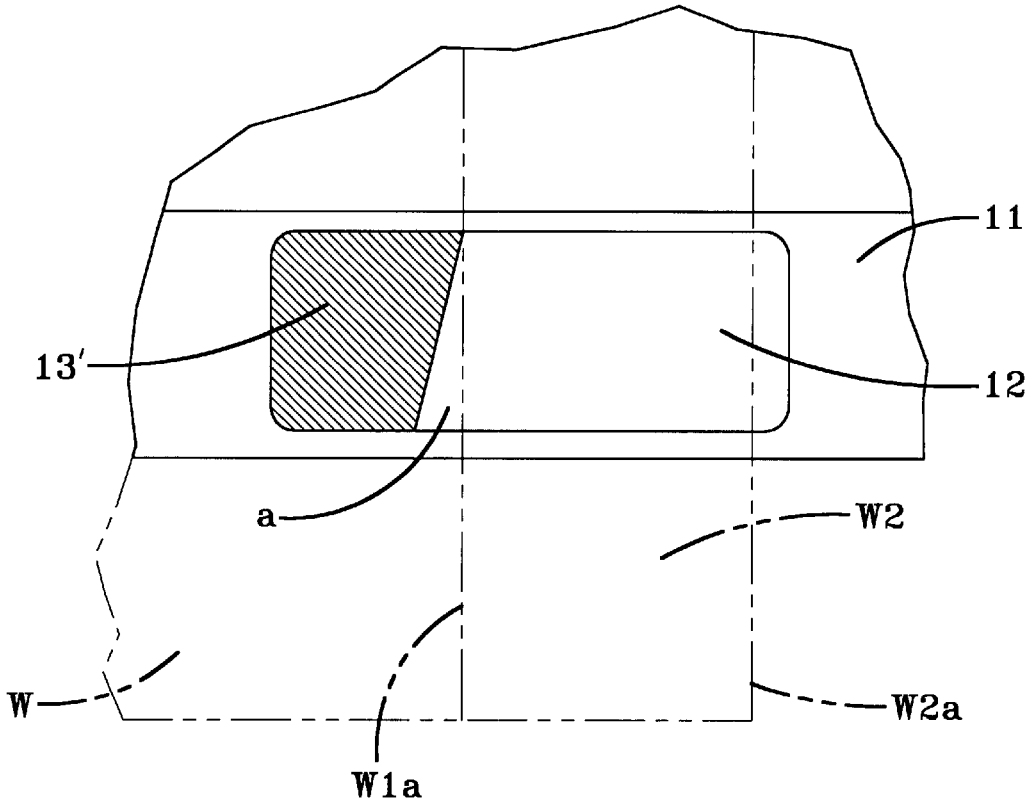
FIG. 9 is an enlarged plan view of a main part illustrating a modification of a matchmark of FIG. 4.

As a matchmark provided on the translucent plate 12, the linear matchmark 13 that is diagonal to the sewing direction Y, as shown in FIG. 4, is employed in the foregoing embodiment. The matchmark 13 may be replaced with any matchmark having a right end that is diagonal to the sewing direction Y. For example, a rectangular matchmark 13' may be used which is obtained by coloring the left region of the translucent plate 12 to non-translucent color, as shown in FIG. 9.

Figure 10:
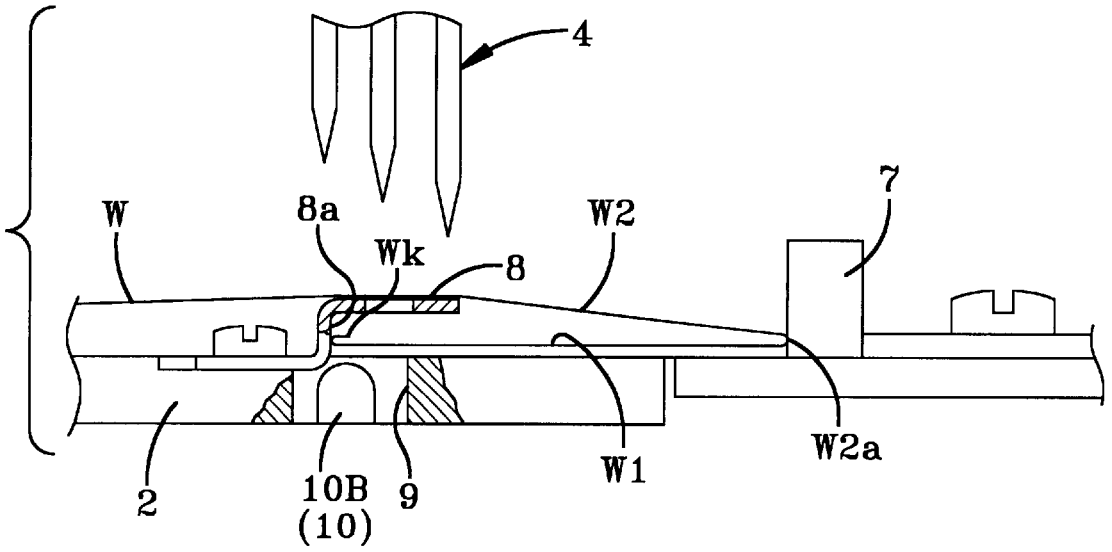
FIG. 10 is a sectional front view, partially in enlarged dimension, of a main part illustrating the state of curl which can be considered as one cause of slippage in a blindstitch hemming sewing.

In the foregoing embodiment, the sensor 10 determines whether the overlapping number of the upper and lower fabric portions W2 and W1 is one or two, in order to detect only the presence of the position error causing slippage as shown in FIG. 7, or the locally deformed portion as shown in FIG. 8. To prevent a faulty sewing due to a curl Wk occurred at the end of the lower fabric portion W1, as shown in FIG. 10, the sensitivity of the receiver 10B of the sensor 10 may be so set as to detect that the overlapping number including the curl Wk is three or more. This is especially suitable for the blindstitch hemming of a thin fabric that tends to curl.

While the invention has been shown and described in detail, the foregoing description is in all aspects illustrative and not restrictive. It is therefore understood that numerous modifications and variations can be devised without departing from the scope of the invention.

What is claimed is:

1. In an interlock stitch sewing machine for blindstitch hemming which comprises a top-stitching width guide that defines the width of a top-stitching toward the back of a fabric and makes contact with a bent portion of a lower fabric portion and an upper fabric portion overlying thereon in said top-stitching, to guidedly feed said bent portion in a sewing direction, and a fabric edge guide that makes contact with an edge of said lower fabric portion to guidedly feed said edge in said sewing direction, said top-stitching width guide and said fabric edge guide being oppositely disposed in front of a needle location in a direction orthogonal to said sewing direction, characterized in having a slippage preventing device comprising:

a slippage detecting sensor attached to said fabric edge guide, said sensor detecting slippage of said upper and lower fabric portions by detecting the position of an edge of said lower fabric portion to be guidedly fed by said fabric edge guide; and an informing means that compares a slippage quantity detected by said slippage detecting sensor and a preset permissible slippage quantity, and, when said slippage quantity exceeds said permissible slippage quantity, determines the possibility of slippage and performs an informing operation.

2. The interlock stitch sewing machine for blindstitch hemming with a slippage preventing device according to claim 1 wherein, a translucent plate that slidingly guides said lower fabric portion in said sewing direction is disposed in front of said fabric edge guide; and a light source applies an upward light to the back of said translucent plate to illuminate said lower fabric portion.

3. The interlock stitch sewing machine for blindstitch hemming with a slippage preventing device according to claim 2 wherein said translucent plate is colored to fluorescent color.

4. The interlock stitch sewing machine for blindstitch hemming with a slippage preventing device according to claim 2 wherein said translucent plate has a linear matchmark, the tip of which is located on an extension line parallel with said sewing direction of said fabric edge guide, and which is, toward its back end, apart from said extension line at a given angle, thereby to align said edge of said lower fabric portion with a vertical guide surface of said fabric edge guide.

5. The interlock stitch sewing machine for blindstitch hemming with a slippage preventing device according to claim 2 wherein said translucent plate has a rectangular matchmark of a non-fluorescent color having one edge, said matchmark being located at its tip on an extension line parallel with said sewing direction of said fabric edge guide, and being apart from said extension line toward its back end, thereby to align said edge of said lower fabric portion with a vertical guide surface of said fabric edge guide.

6. The interlock stitch sewing machine for blindstitch hemming with a slippage preventing device according to claim 1 wherein said slippage detecting sensor has a receiver set to such a sensitivity as to perform detection even when the overlapping number of overlapped fabric portions including a curl occurred at the end of said lower fabric portion is three or more.

* * * * *